US006381890B1

(12) United States Patent
Sjöstedt

(10) Patent No.: US 6,381,890 B1
(45) Date of Patent: May 7, 2002

(54) MARKING SYSTEM

(76) Inventor: Agneta Sjöstedt, Vivelvägen 11, SE-125 33, Älvsjö (SE)

( * ) Notice: Subject to any disclaimer, the term of this patent is extended or adjusted under 35 U.S.C. 154(b) by 0 days.

(21) Appl. No.: 09/807,006

(22) PCT Filed: Oct. 8, 1999

(86) PCT No.: PCT/SE99/01810

§ 371 Date: Apr. 6, 2001

§ 102(e) Date: Apr. 6, 2001

(87) PCT Pub. No.: WO00/22600

PCT Pub. Date: Apr. 20, 2000

(30) Foreign Application Priority Data

Oct. 9, 1998 (SE) ..... 9803451

(51) Int. Cl.[7] ..... G09F 3/08

(52) U.S. Cl. ..... 40/637; 40/600; 40/661.01; 248/206.5; 248/683

(58) Field of Search ..... 40/600, 661.01, 40/637; 248/706.5, 683

(56) References Cited

U.S. PATENT DOCUMENTS

| | | | | | |
|---|---|---|---|---|---|
| 2,644,212 | A | * | 7/1953 | Markowitz | 248/206.5 |
| 2,876,359 | A | * | 3/1959 | Plamale | 248/206.5 |
| 4,100,684 | A | * | 7/1978 | Berger | 248/206.5 |
| 4,159,587 | A | | 7/1979 | Slavsky | |
| 4,677,780 | A | | 7/1987 | Shuman | |
| 4,875,654 | A | * | 10/1989 | Chandonnet et al. | 248/206.5 |
| 5,609,317 | A | | 3/1997 | Glynn et al. | |
| 5,778,583 | A | | 7/1998 | Larsen | |

FOREIGN PATENT DOCUMENTS

| | | | | |
|---|---|---|---|---|
| CA | 707857 | * | 4/1965 | 248/206.5 |
| CH | 448202 | * | 3/1968 | 248/206.5 |
| FR | 1126224 | * | 11/1956 | 248/206.5 |
| GB | 2129594 A | | 6/1983 | G09F/7/18 |

* cited by examiner

*Primary Examiner*—Cassandra H. Davis
(74) *Attorney, Agent, or Firm*—Michael D. Bednarek; Shaw Pittman LLP

(57) ABSTRACT

A product marking system particularly for marking delicatessen or cheeses at a manned service counter for the purpose of displaying the identity or price of the product. The marking system includes a sign (4) that has a foot (41). A connecting element (2) is adapted to stably embrace the product (1) and to carry an attachment means (3) for releasable magnetic connection with the foot (41).

10 Claims, 2 Drawing Sheets

MARKING SYSTEM

The present invention relates to a labelling system for marking the price or the identity of products, such as delicatessen or cheeses at a manned service counter, said system including a foot-mounted label or sign.

One problem encountered when selling products such as cheese and delicatessen for instance, particularly at manned service counters, is that the products, for instance cheeses and sausages, must carry an appropriate label or sign that tells the customer the price and/or the name of the product concerned. It is also often necessary to remove the sign completely or move the sign and then return it to the product after the counter attendant has cut away a piece of the product requested by the customer.

One type of known sign includes a needle that is stuck into the product. This type of price sign is now used to a much lesser extent and is forbidden in many parts of the world since foreign substances, for instance harmful micro-organisms, can readily accompany the needle into the product.

Instead, it has been necessary to use foot-mounted signs with the sign standing on the product concerned, said foot being made relatively heavy so that the center of gravity of the sign will be located in the proximity of the surface of the foot on which the sign is mounted. The foot may be shaped or capable of being shaped to ensure that the sign will rest stably on top of a non-planar surface, for instance on a sausage. However, the shapes and slopes of the products vary greatly. U.S. Pat. No. 4,159,587 describes price signs of the aforesaid kind. Although the foot can be shaped, it is still necessary for the foot to be shaped to the display position of the product concerned, and the shape or contours of the product will often vary after a piece of the product has been removed for sale.

One problem associated with such products is that they do not provide a stable and unitary support for a moveable price sign that may not be affixed to the product with the aid of a needle and which cannot be placed adjacent the product for practical reasons.

One object of the invention is to provide a marking system which enables the sign to be readily placed firmly on the product concerned and to be replaced thereon after having been moved temporarily from said product.

This object is achieved with a marking system according to the accompanying claim 1.

Further embodiments of the invention are set forth in the dependent Claims.

According to one illustrative embodiment of the invention, an iron plate is encapsulated in an elastic band that embraces the product and holds the plate firmly there against. The foot of the price sign is provided with a permanent magnet that connects the sign releasably to the foot. This enables the sign to be easily removed from the plate and replaced on the plate, even when said plate is inclined steeply to the horizontal plane. The elastic band carrying the plate can be easily moved along the product so as to enable pieces or slices to be cut from the product in accordance with the customer's wishes. The elastic band carrying the plate can also be easily removed if cutting of the product should so require, and then replaced on the product. This avoids the introduction of contaminants inwardly of the outer surface of the product. The skilled person will realise the other advantages that are afforded by the invention.

The skilled person will also realise that the plate may consist of a permanent magnet while the foot of the sign consists of a thermomagnetic material.

The invention will now be described in more detail by way of example with reference to the accompanying drawings.

Figure 1:
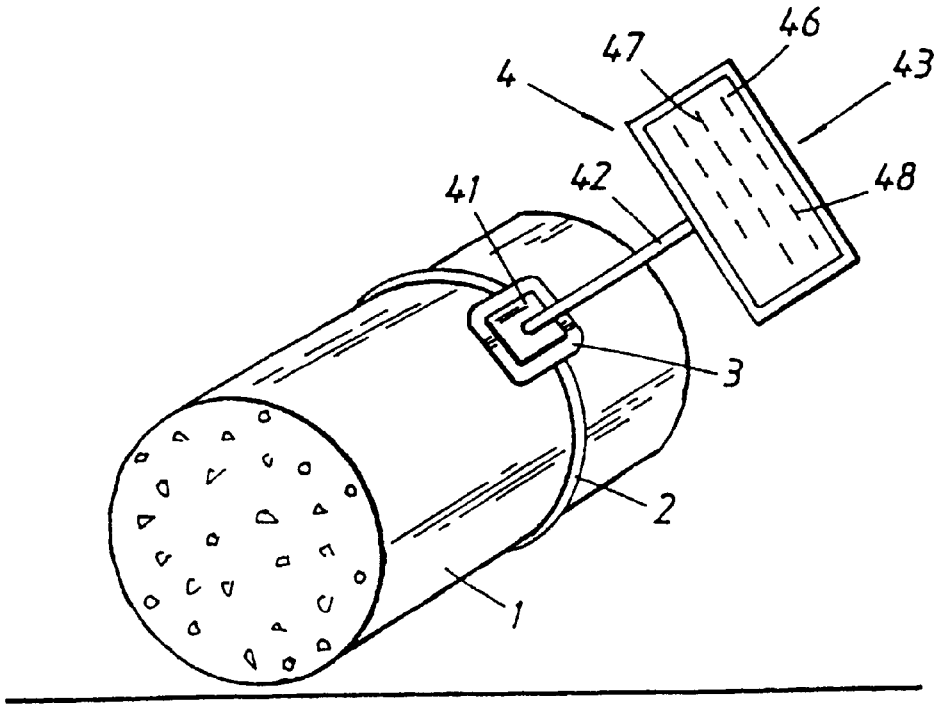
FIG. 1 is a schematic illustration of a price marking system applied to a product.

FIG. 1 illustrates a product 1 in the form of a sausage portion as a typical representative of the products or goods concerned. A sign 4 is mounted on the product 1. The sign 4 typically includes a foot plate 41 which carries a frame 43 on which there is mounted a label 46 that displays information 47 relating to the cost of the product or its price per unit weight, together with other information 48 relating to the identity of the product concerned, for instance.

A rubber band 2 carrying a plate 3 is stretched around the product 1. The plate 3 includes ferromagnetic material, for instance stainless steel, and the foot 41 of the sign includes a permanent magnet 13, so that the sign will be supported stably by the plate 3 even should the center of gravity of the sign 4 lie outwardly of the horizontal projection of the foot 41.

The releasable magnetic coupling between foot 41 and plate 3 can be easily broken manually, so as to allow personnel on the manned service counter to cut away a piece of the product 1 in accordance with the customer's wishes. If necessary, the personnel can move the rubber band 2 carrying said plate 3 along the product, or may remove the rubber band and plate 3 completely prior to cutting said product, and then replace the rubber band and plate 3 on the product. As indicated, the sign 4 can be supported stably by the plate 3 even if the sign should slope steeply relative to the horizontal plane, so that the sign 4 will always be associated with the product even should its orientation or position be disturbed.

As will be understood, the rubber band 2 and the plate 3 may be provided as a disposable item that can be discarded when the whole of the product 1 has been sold. The rubber band 2 constitutes a variant of a device for connecting the plate 3 to the product 1, preferably releasably.

Figure 2:
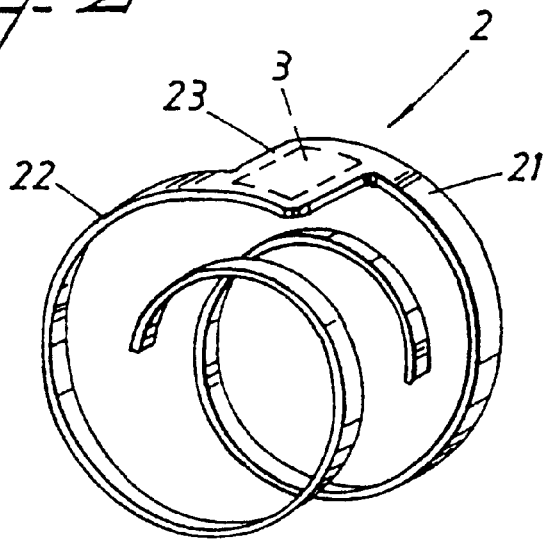
FIG. 2 illustrates an alternative embodiment applied to a product.

As illustrated in FIG. 2, the plate 3 may alternatively be moulded in a plastic plate 23 that includes integrally therewith two elastic helically shaped and generally coaxial bands 21, 22 that extend in mutually opposite directions from the plate 23. The illustrate memory shape of the bands 21, 22 conveniently has a diameter that is smaller than the smallest product that shall be provided with the marking system, such that the bands 21, 22 will have an effective gripping function at least while the bands together embrace more than half the circumference or perimeter of the product.

Naturally, the embodiment according to FIG. 2 may e modified to include only one helical band, this single helical band preferably being dimensioned to embrace more than half the perimeter or circumference of an anticipated largest product.

In another embodiment, one part of the magnetic coupling 3, 13 may be carried by an attachment 36, 37 which includes an end part 36 that forms a fitting for the part 3 or which encloses said part, and a pin or point 37 which can be inserted into the product, for instance in an end part thereof, opposite to that end from which slices or pieces shall be cut for sale, so that the attachment 36, 37 can remain seated in the product 1 until essentially all of the product has been sold, without obstructing slicing of the product. The embodiment according to FIG. 3 is made possible by the magnetic coupling 3, 13 that enables the sign 4 to be easily removed temporarily whilst cutting the product and then simply replaced on the attachment.

Figure 3:
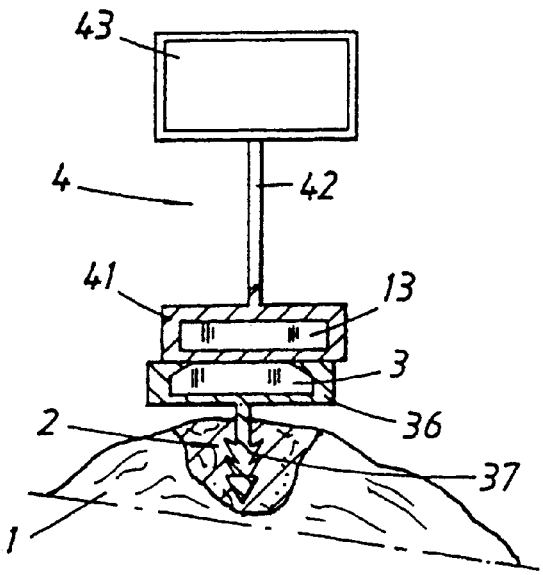
FIG. 3 illustrates another embodiment of the price marking system.

Although the part 3 is shown to be exposed in FIG. 3, it will be understood that said part can be fully embedded in the fitting 36.

Figure 4:
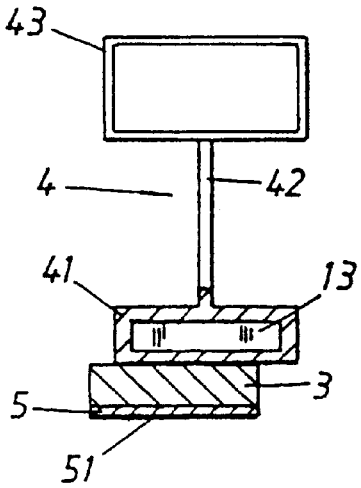
FIG. 4 illustrates another embodiment of the price marking system.

The alternative embodiment shown in FIG. 4 also includes a permanent magnet 13 embedded in the foot 41 and involves the use of a ferromagnetic body 3 which has on one side a cover 5 whose exposed surface 51 is adhesive for releasable attachment to a material compatible with the adhesive substance, for instance plastic foil, wrapping paper or the like; particularly product wrapping material.

As will be understood, the plate 3 of the FIG. 3 embodiment may, as an alternative, include integral therewith a pin corresponding to the illustrated pin 37. The permanent magnet 13 is preferably provided in the foot 41 of the sign 4 or forms the foot 41 itself, wherewith the attachment 3 is formed by or includes a ferromagnetic material 3 or a permanent magnet that is adapted to coact with the permanent magnet 13. The attachment 3 may, of course, include a permanent magnet and the foot 41 include a ferromagnetic body if so desired.

Figure 5:
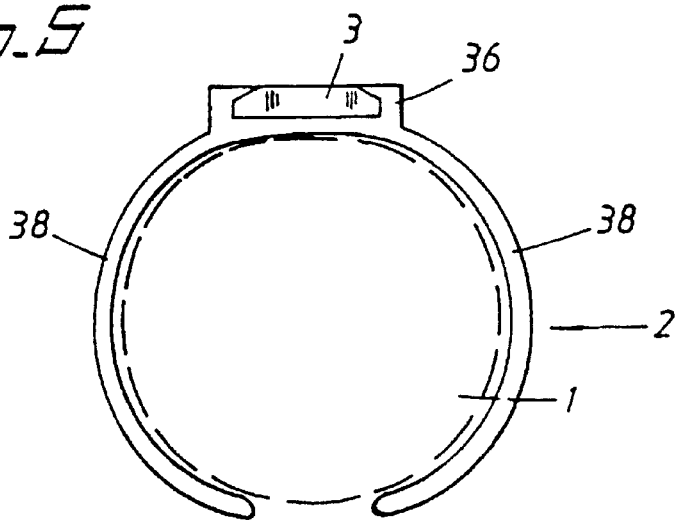
FIG. 5 illustrates a further variant of a device for anchoring one part of the releasable magnetic connection of the system to a product.

FIG. 5 illustrates a further variant in which the plate 3 is carried by a fitting 36 that includes two oppositely curved and elastically springy arms 38 that can be caused to grip stably around the major part of the circumference or perimeter of a product 1.

What is claimed is:

1. A product marking system for displaying at least one of an identity and price of a product, the marking system comprising a connecting element (2) for connecting with said product, and a sign (4) connected to said connecting element, characterized in that the sign (4) includes a foot (41) which carries part of a magnetic coupling; and in that the connecting element (2) includes an attachment (3) which carries another part of the magnetic coupling, such as to enable the sign to be connected releasably to the attachment of said connecting element (2), wherein the connecting element (2) includes a rubber band which is adapted to embrace the product in a tensioned state so as to firmly hold the attachment (3) to said product.

2. A system according to claim 1, wherein the product is one of delicatessen and cheese.

3. A system according to claim 1, characterized in that one of the foot (41) and attachment (3) comprises ferromagnetic material and the other of the foot (41) and attachment (3) comprises a permanent magnet.

4. A system according to claim 1, characterized in that the foot (41) and the attachment (3) are each provided with a permanent magnet for releasable magnetic coupling of one to the other.

5. A product marking system for displaying at least one of an identity and price of a product, the marking system comprising a connecting element (2) for connecting with said product, and a sign (4) connected to said connecting element, characterized in that the sign (4) includes a foot (41) which carries part of a magnetic coupling; and in that the connecting element (2) includes an attachment (3) which carries another part of the magnetic coupling, such as to enable the sign to be connected releasably to the attachment of said connecting element, wherein the connecting element (2) includes at least one elongated elastic element (21, 22) that has a memory shape in which said elongated elastic element embraces the product at least partially.

6. A system according to claim 5, wherein the product is one of delicatessen and cheese.

7. A system according to claim 5, characterized in that one of the foot (41) and attachment (3) comprises ferromagnetic material and the other of the foot (41) and attachment (3) comprises a permanent magnet.

8. A system according to claim 5, characterized in that the foot (41) and the attachment (3) are each provided with a permanent magnet for releasable magnetic coupling of one to the other.

9. A system according to claim 5, characterized in that said element (21, 22) has a generally helical shape.

10. A system according to claim 5, characterized in that the connecting element (2) includes two members (21, 22) that extend in generally opposite directions so as together grip around at least a part of said product.

* * * * *